US011506429B2

(12) United States Patent
Muller et al.

(10) Patent No.: US 11,506,429 B2
(45) Date of Patent: Nov. 22, 2022

(54) REFRIGERATION APPARATUS

(71) Applicant: Carrier Corporation, Palm Beach Gardens, FL (US)

(72) Inventors: Raphael Muller, Lyons (FR); Charbel Rahhal, Lyons (FR); Jeremy Wallet-Laily, Saint Cyr au mont d'or (FR); Antoine Barriere, Villeurbanne (FR)

(73) Assignee: CARRIER CORPORATION, Palm Beach Gardens, FL (US)

( * ) Notice: Subject to any disclaimer, the term of this patent is extended or adjusted under 35 U.S.C. 154(b) by 190 days.

(21) Appl. No.: 16/875,317

(22) Filed: May 15, 2020

(65) Prior Publication Data

US 2020/0370798 A1 Nov. 26, 2020

(30) Foreign Application Priority Data

May 21, 2019 (EP) ..... 19175793

(51) Int. Cl.
*F25B 31/00* (2006.01)
*F25B 21/02* (2006.01)
*F25B 1/047* (2006.01)

(52) U.S. Cl.
CPC ..... *F25B 31/002* (2013.01); *F25B 1/047* (2013.01); *F25B 21/02* (2013.01); *F25B 2500/16* (2013.01)

(58) Field of Classification Search
CPC ..... F25B 31/002; F25B 2500/16; F25B 1/00; F25B 1/02; F25B 1/04; F25B 1/047;
(Continued)

(56) References Cited

U.S. PATENT DOCUMENTS 6,755,039 B2 * 6/2004 Tsuboi ..... F04C 29/0014 62/113
8,104,298 B2 * 1/2012 Sishtla ..... F16C 33/109 62/84

(Continued)

FOREIGN PATENT DOCUMENTS

| | | | |
|---|---|---|---|
| EP | 1400765 | A2 | 3/2004 |
| WO | 2007067169 | A1 | 6/2007 |
| WO | 2009023027 | A1 | 2/2009 |

OTHER PUBLICATIONS

European Search Report for application EP 19175793.9, dated Jul. 11, 2019, 7 pages.

*Primary Examiner* — Miguel A Diaz
(74) *Attorney, Agent, or Firm* — Cantor Colburn LLP

(57) ABSTRACT

A refrigeration apparatus (1) includes a main refrigerant circuit (2) including a positive displacement compressor (4), a condenser (6), an expansion valve (8), and an evaporator (10), through which a refrigerant circulates successively in a closed loop circulation, a lubrication refrigerant line (18) connected to the main refrigerant circuit (2) between the condenser (6) and the expansion valve (8) or to the condenser (6), in which circulates a portion of the refrigerant of the main refrigerant circuit (2) and connected to the compressor (4) for lubrication of said compressor (4) with the refrigerant, at least one lubrication refrigerant storing cavity (70) connected to the lubrication refrigerant line (18), the lubrication refrigerant storing cavity (70) being configured to store liquid refrigerant for lubrication of the compressor (4) said at least one lubrication refrigerant storing cavity (70) being provided within the compressor (4).

13 Claims, 4 Drawing Sheets

(58) Field of Classification Search
CPC ..... F25B 1/053; F25B 21/00; F25B 21/02; F25B 21/04
See application file for complete search history.

(56) References Cited

U.S. PATENT DOCUMENTS

| | | | | |
|---|---|---|---|---|
| 2004/0050081 | A1* | 3/2004 | Tsuboi | F25B 1/047 62/197 |
| 2005/0183429 | A1* | 8/2005 | Rafalovich | F25D 21/04 62/155 |
| 2008/0196861 | A1* | 8/2008 | Burns | F04B 39/122 165/61 |
| 2008/0245082 | A1* | 10/2008 | Sishtla | F16C 39/02 62/84 |
| 2010/0146990 | A1* | 6/2010 | Taras | F25B 21/02 62/3.2 |
| 2017/0146271 | A1 | 5/2017 | Hasegawa et al. | |
| 2018/0209697 | A1* | 7/2018 | Nishida | F25B 1/10 |

* cited by examiner

REFRIGERATION APPARATUS

FOREIGN PRIORITY

This application claims priority to European Patent Application No. 19175793.9, filed May 21, 2019, and all the benefits accruing therefrom under 35 U.S.C. § 119, the contents of which in its entirety are herein incorporated by reference.

BACKGROUND

The present invention concerns a refrigeration apparatus.

A refrigeration apparatus is known from EP 1 400 765, comprising a refrigerant circuit including a screw compressor, a condenser, an expansion valve and an evaporator. This known apparatus comprises a bypass flow passage, branching at a part of said refrigerant circuit between the condenser and the expansion valve, the passage routing through throttle means, and communicating with a rotor cavity and with bearings of the screw compressor. Lubrication of the compressor is achieved by the same fluid that is also used as the refrigerant in the circuit, and in the absence of oil.

For successfully lubricating the rotor cavity and the bearings during the start of the refrigeration apparatus after a standby period or at the first start-up, one must ensure that a minimal amount of lubrication refrigerant is present in liquid state in the rotor cavity and in the bearings, to avoid potential damages on the compressor. In some cases, depending on the location of the compressor with respect to the other components of the main refrigerant circuit, the liquid refrigerant may not be in sufficient quantity in the bypass flow passage to properly lubricate the compressor. After a period of standby, or before the first start of the refrigeration apparatus, the liquid refrigerant present in the lubrication line may not be in sufficient quantity to properly lubricate the compressor at the first start or restart, or might have migrated towards another part of the main circuit. For example, the liquid refrigerant may have migrated by gravity to a low part of the refrigerant circuit remote from the compressor.

SUMMARY

An aim of the invention is to provide a refrigeration apparatus where proper lubrication of the compressor by the refrigerant is guaranteed during the start of the refrigeration apparatus.

To this end, the invention concerns a refrigeration apparatus comprising: a main refrigerant circuit including a positive displacement compressor, a condenser, an expansion valve, and an evaporator, through which a refrigerant circulates successively in a closed loop circulation; a lubrication refrigerant line connected to the main refrigerant circuit between the condenser and the expansion valve or to the condenser, in which circulates a portion of the refrigerant of the main refrigerant circuit and connected to the compressor for lubrication of said compressor with the refrigerant; The refrigeration apparatus comprises: at least one lubrication refrigerant storing cavity connected to the lubrication refrigerant line, the lubrication refrigerant storing cavity being configured to store liquid refrigerant for lubrication of the compressor said at least one lubrication refrigerant storing cavity being provided within the compressor and being in fluid connection with at least a compression chamber of the compressor; at least one cooling device provided within the compressor and configured to cool down the refrigerant stored in said at least one lubrication refrigerant storing cavity prior to a starting operation of the refrigeration apparatus.

Thanks to the invention, a minimal quantity of lubrication refrigerant is retained in the cavity within the compressor and is available before or during a starting operation of the compressor. The cooling device guarantees that the lubrication refrigerant is mostly in liquid state in the cavity to ensure sufficient lubrication and avoid potential damages to the compressor during starting.

According to further aspects of the invention that are advantageous but not mandatory, such a refrigeration apparatus may incorporate one or several of the following features: The refrigeration apparatus comprises several lubrication refrigerant storing cavities distributed within the compressor, at least one of said lubrication refrigerant storing cavities being in connection with the compression chamber and with at least one bearing chamber within the compressor. The refrigeration apparatus comprises several lubrication refrigerant storing cavities distributed within the compressor, at least one of said lubrication refrigerant storing cavities being in connection with the compression chamber, and at least one of said lubrication refrigerant storing cavities being in connection with bearing chambers within the compressor. The compressor comprises a suction side bearing chamber and a discharge side bearing chamber, wherein the refrigeration apparatus comprises two lubrication refrigerant storing cavities connected with the suction side bearing chamber, two lubrication refrigerant storing cavities connected with the discharge side bearing chamber and one lubrication refrigerant storing cavity connected with the compression chamber. The refrigeration apparatus comprises, for each of said lubrication refrigerant storing cavities, at least one cooling device configured to cool down the refrigerant stored in said lubrication refrigerant storing cavity. The at least one lubrication refrigerant cavity is formed by the compression chamber itself. The at least one cooling device comprises at least one thermoelectric cooler. The refrigeration apparatus comprises an electrical power supply unit configured to feed said at least one thermoelectric cooler with electrical current on a starting operation of the refrigeration apparatus. The electrical power supply unit is configured to feed said at least one thermoelectric cooler with electrical current during a limited duration ranging between several seconds and several minutes. The refrigeration apparatus comprises heat dissipation means configured to dissipate a heat generated by said at least one thermoelectric cooler, and wherein the heat dissipation means are formed by a housing of the compressor. The at least one cooling device is formed by a magnetic cooler. The refrigeration apparatus comprises at least one heating device mounted on the condenser, or on the evaporator, or both, and configured to heat up the refrigerant contained in the condenser and/or the evaporator to induce migration of liquid refrigerant towards said at least one lubrication refrigerant cavity. The refrigeration apparatus operates an oil free refrigerant cycle.

DRAWING DESCRIPTION

Exemplary embodiments according to the invention and including further advantageous features of the invention are explained below, referring to the attached drawings, in which.

DETAILED DESCRIPTION

Figure 1:
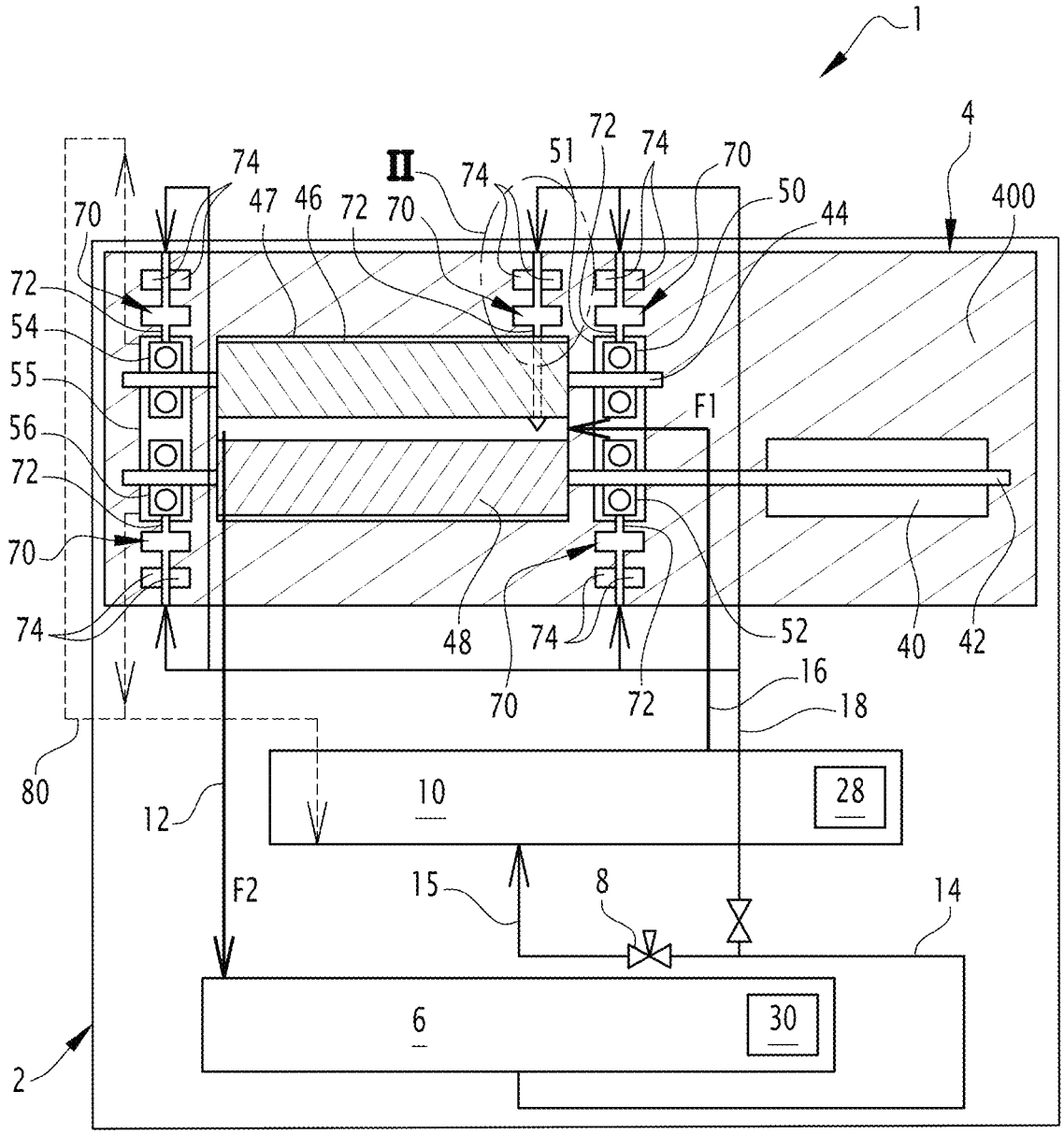
FIG. 1 is a synoptic drawing showing a refrigeration apparatus according to a first embodiment of the invention.

FIG. 1 represents a refrigeration apparatus 1, comprising a main refrigerant circuit 2 through which a refrigerant circulates in a closed loop circulation. The main refrigerant circuit 2 comprises four main components: a positive displacement compressor 4, also called volumetric compressor, a condenser 6, an expansion valve 8, and an evaporator 10. The refrigerant circulates successively in these four components according to a thermodynamic cycle.

Preferably, in a steady-state, during a high load operation of the refrigeration apparatus 1: in the compressor 4, the refrigerant is in a gaseous state, and is compressed from a low pressure to a high pressure, which raises the temperature of the refrigerant from a low temperature to a high temperature; in a discharge line 12 connecting the compressor 4 to the condenser 6, the refrigerant is in a gaseous state, or essentially gaseous state, and is at the high temperature and the high pressure; in the condenser 6, the refrigerant is in a bi-phasic state, including gaseous and liquid refrigerant, and is condensed to a liquid state by the condenser 6; in a line 14 connecting the condenser 6 to the expansion valve 8, the refrigerant is in a liquid state, or essentially liquid state, is at the high pressure, and may be at the high temperature or at a temperature between the high temperature and the low temperature; in the expansion valve 8, the refrigerant is brought to the low pressure, which lowers the temperature of the refrigerant to the low temperature while evaporating the refrigerant to the bi-phasic state; in a line 15 connecting the expansion valve 8 to the evaporator 10, the refrigerant is in a biphasic-state, where a major part is liquid and a smaller part is gaseous, and the refrigerant is at the low temperature and the low pressure; in the evaporator 10, the refrigerant is in a bi-phasic state, including gaseous and liquid refrigerant, and is evaporated to a gaseous state by the evaporator 10; in a suction line 16 connecting the evaporator 10 to the compressor 4, the refrigerant is in a gaseous state, or essentially gaseous state, at the low pressure and at a low temperature, or at a temperature between the low and the high temperature.

For example, the low temperature is approximately between 5-10° C., the high temperature is approximately between 35-40° C., the low pressure is approximately between 3-4 bar, and the high pressure is approximately between 6-10 bar.

Considering the above, the main circuit 2 comprises a high-pressure part, consisting in the discharge line 12, the condenser 6 and the line 14, and a low-pressure part, consisting in the line 15, the evaporator 10 and the suction line 16.

In a part of the main circuit 2, which covers only a portion of the high-pressure part, preferably consisting in the condenser 6 and the line 14, the refrigerant is mostly in liquid state and high pressure.

The positive-displacement compressor 4 may be chosen between at least a scroll compressor, a screw compressor, a piston compressor, a rotary compressor, or a Roots compressor. The compressor 4 comprises rotors and bearings. To insure the proper operation of the compressor 4, it is essential that the rotors and the bearings are lubricated.

The refrigerant of the refrigeration apparatus 1 is a fluid material chosen to ensure both functions of refrigerant and lubricant. Preferably, the refrigerant used in the refrigeration apparatus 1 is a hydrofluoroolefin (HFO), for example R1234ze (1,3,3,3-tetrafluoroprop-1-ene). There is therefore no lubrication oil present in the main refrigerant circuit 2. The refrigeration apparatus 1 is operating an oil-free refrigerant cycle.

In the condenser 6 and between the condenser 6 and the expansion valve 8, where the refrigerant of the main circuit 2 it mostly in liquid state and at high pressure, is the part of the main circuit 2 where the refrigerant is in the most appropriate state to be used as lubricant.

The refrigeration apparatus 1 comprises a lubrication refrigerant line 18 connected between the condenser 6 and the expansion valve 8, and connected to the compressor 4 for lubrication of said compressor 4 with the liquid refrigerant. According to a non-shown embodiment, the lubrication refrigerant line 18 may be connected to the condenser 6, for example in a bottom area of the condenser 6.

To prevent a shortage of lubricant that may result in damage to the compressor 4 during a first start-up or restart, the refrigeration apparatus 1 comprises at least one lubrication refrigerant storing cavity provided within the compressor 4, connected to the lubrication refrigerant line 18, the lubrication refrigerant storing cavity being configured to store liquid refrigerant for lubrication of the compressor 4, and at least one cooling device configured to cool down the refrigerant stored in said at least one lubrication refrigerant storing cavity prior to a starting operation of the refrigeration apparatus 1. The at least one cooling device is also provided within the compressor 4.

The lubrication refrigerant storing cavity is configured to store liquid refrigerant for lubrication of the compressor 4. The lubricant refrigerant storing cavity retains a given quantity of liquid refrigerant and is connected to the compressor 4 so that a sufficient quantity of refrigerant is provided to the compressor 4 for lubrication purpose.

In one embodiment, the cooling device may be a thermoelectric cooler. The thermoelectric cooler, also called "Peltier module" generates a temperature difference between two plates separated by a semiconductor medium in which circulates an electrical current. A first plate called "cold side" becomes colder and can cool down another element or any suitable medium, while a second plate called "hot side" becomes hotter and can heat up another element or any suitable medium.

The cooling device permits to insure that the refrigerant is duly in liquid state prior to being injected into the compressor 4, and creates a cold point to induce a phenomenon of spontaneous migration of the liquid refrigerant towards the storing cavities. This cold point, which may form in this case the coldest part of the refrigeration apparatus 1, condenses any gaseous part of the refrigerant present in the cavities, creating a depression that attracts gaseous and liquid refrigerant towards the cavities. This phenomenon of spontaneous migration of the refrigerant renders use of an additional pump in the lubrication refrigerant line 18 unnecessary, as the circulation of liquid refrigerant towards the cavities is self-induced. This avoids the use of costly parts and additional fluid lines, which may increase the cost of the refrigeration apparatus and lead to more failures due to additional moving parts.

The at least one lubrication refrigerant storing cavity is provided within the compressor 4, and is in fluid connection with at least a compression chamber 47 of the compressor 4, where the refrigerant is compressed under action of the rotors of the compressor 4, and bearing chambers which house bearings of the compressor 4.

In an embodiment, the compressor 4 is a screw compressor. As shown in FIG. 1, the compressor 4 comprises a motor 40, powered by a non-shown power supply, which may be of electrical type. The motor 40 drives a primary shaft 42, whose rotation is supported by bearings 52 and 56. A first screw 48 is mounted on the primary shaft 42 and is driven in rotation by the primary shaft 42. The compressor 4 comprises a secondary shaft 44, whose rotation is supported by bearings 50 and 54, and which drives in rotation a second screw 46. The screws 46 and 48 mesh together in a male-female cooperation under action of the motor 40. The screws 46 and 48 form the rotors of the compressor 4, and are located in the compression chamber 47. The gaseous refrigerant enters the compression chamber 47 along an arrow F1 from the suction line 16. The bearings 50 and 52 located on the suction side of the compression chamber 47 are called suction bearings. The suction bearings 50 and 52 are located in a chamber of the compressor 4 that forms a suction side bearing chamber 51. The gaseous refrigerant compressed by the meshed screws 46 and 48 is discharged from the compressor along a path indicated by arrow F2 towards the discharge line 12. The bearings 54 and 56 located on the discharge side of the compression chamber 47 are called discharge bearings. The discharge bearings 54 and 56 are located in a chamber of the compressor 4 that forms a discharge side bearing chamber 55. The compressor comprises a housing 400 in which are mounted the motor 40, the primary and secondary shafts 42 and 44, the bearings 50, 52, 54, 56 and the screws 46 and 48. The compression chamber 47, the suction side bearing chamber 51 and the discharge side bearing chamber 55 are formed in the housing 400.

The refrigeration apparatus 1 comprises several lubrication refrigerant storing cavities 70 distributed within the compressor 4, at least one of these lubrication refrigerant storing cavities 70 being in fluid connection with the compression chamber 47, and at least one of said lubrication refrigerant storing cavities 70 being in connection with one of the suction side bearing chamber 51 and the discharge side bearing chamber 55.

Each of the screws 46 and 48 and the bearings 50, 52, 54, 56 is therefore provided with a minimal quantity of lubrication refrigerant stored in a lubrication refrigerant storing cavity 70 prior or during a starting operation of the compressor 4. Each of the lubrication refrigerant storing cavities 70 is in fluid connection with the lubrication refrigerant line 18. The lubrication refrigerant storing cavities 70 are provided in the housing 400 and are connected to the compression chamber 47, the suction side bearing chamber 51 and the discharge side bearing chamber 55 by ducts 72 provided in the housing 400 between the cavities 70 and the compression chamber 47, the suction side bearing chamber 51 and the discharge side bearing chamber 55.

The duct 72 that leads to the compression chamber 47 is located towards the suction side of the compression chamber 47, and injects lubrication refrigerant between the screws 46 and 48, as shown in dotted arrow. The meshing of the screws 46 and 48 then distributes the refrigerant on the whole surface of the screws 46 and 48 and towards the discharge side of the compression chamber 47.

In one embodiment, the refrigeration apparatus 1 comprises two lubrication refrigerant storing cavities 70 connected with the suction side bearing chamber 51, two lubrication refrigerant storing cavities 70 connected with the discharge side bearing chamber 55 and one lubrication refrigerant storing cavity 70 connected with the compression chamber 47. Each of these cavities 70 is associated with at least one thermoelectric cooler 74 configured to cool down the refrigerant stored in these cavities 70.

In one embodiment, for each lubrication refrigerant storing cavity 70, two thermoelectric coolers 74 configured to cool down the refrigerant stored in said lubrication refrigerant storing cavity 70 are provided.

Figure 2:
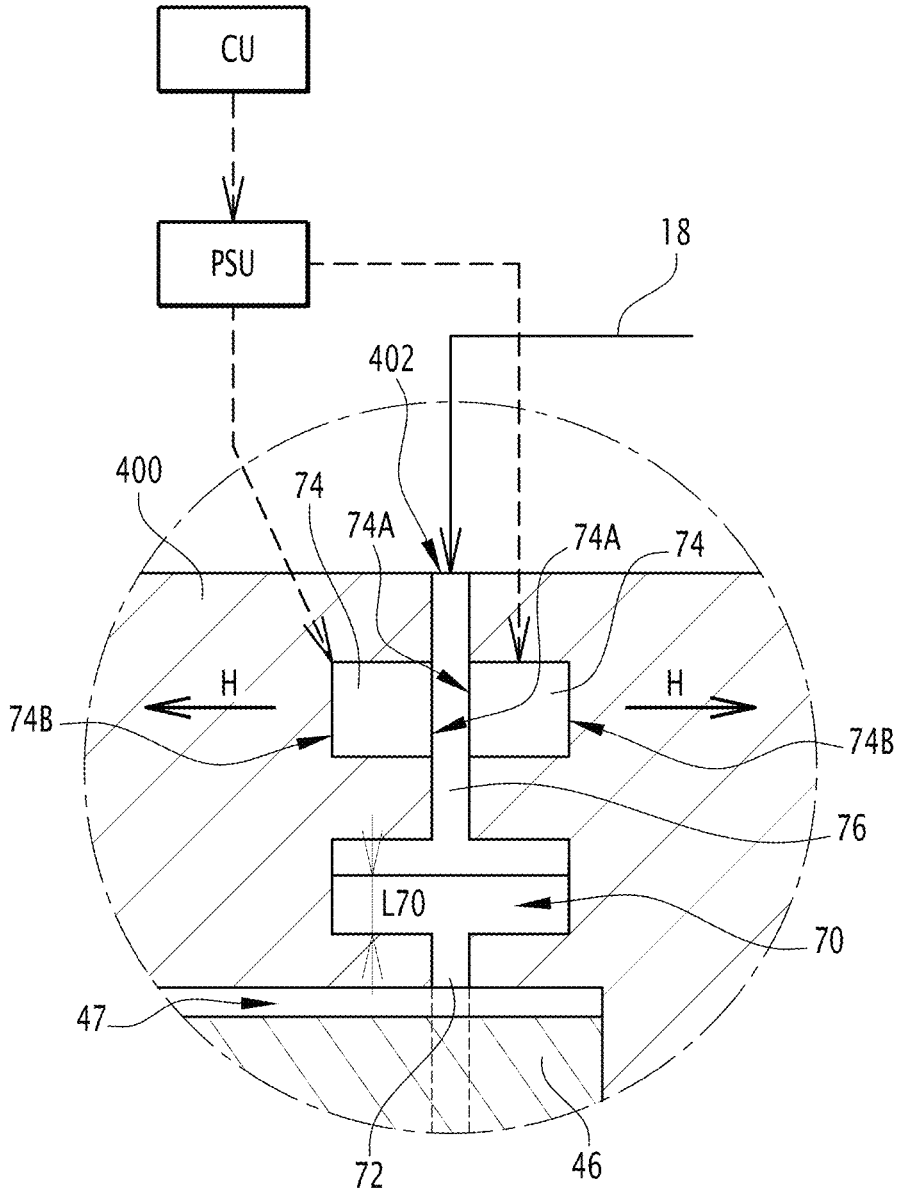
FIG. 2 is a view at a larger scale of detail II on FIG. 1.

As shown in FIG. 2 in more detail, each cavity 70 may comprise a duct 76 connecting the cavity 70 to a hole 402 of the housing 400, said hole 402 being in fluid connection with the lubrication refrigerant line 18. The thermoelectric coolers 74 may be provided around the duct 76, with a cold side 74A located in the duct 76 or forming a portion of the duct 76, and a hot side 74B mounted in the housing 400 opposite from the duct 76. The refrigerant flowing in the cavities 70 is therefore cooled down so that the refrigerant stored in the cavities 70 is duly in liquid state in view of an upcoming starting operation.

As shown in FIG. 2, the refrigeration apparatus 1 may comprise an electrical power supply unit PSU configured to feed the thermoelectric coolers 74 with electrical current on a starting operation of the refrigeration apparatus 1. The electrical power supply unit PSU may be controlled by a control unit CU of the refrigeration apparatus 1. On starting operations, the control unit CU controls the power supply unit PSU to feed electrical current to the thermoelectric coolers 74. Once the starting operation is over, the thermoelectric coolers 74 may be deactivated by commanding stoppage of the feeding with electrical current by the power supply unit PSU. The thermoelectric coolers 74 may be activated during limited durations, ranging for example between several seconds and several minutes depending on the needs for lubrication refrigerant.

The housing 400 of the compressor 4 forms heat dissipation means that dissipate the heat generated by the hot sides 74B of the thermoelectric coolers 74. The housing 400 is generally made of a metallic material and may be surrounded by air for cooling purpose of the compressor 4, allowing thermal dissipation in the surrounding air. The use of the housing 400 as heat dissipation means avoids the need for additional heat sinks, which may increase the cost of the refrigeration apparatus 1.

The cavities 70 and the thermoelectric cooler 74 being housed within the compressor 4 avoid the use of additional external devices for storing lubricant and reduce the cost of the refrigeration apparatus 1.

In a non-shown embodiment, the cavities 70 may comprise detection means to monitor a level L70 of liquid lubricant in the cavities 70. These detection means may comprise, for example, optical sensors, floaters, or any other convenient mean. The detection means may detect a low level of lubrication refrigerant, or a high level, requested to allow the compressor 4 to start. The level measures obtained by the detection means may be transmitted to the control unit CU to allow or disallow starting of the compressor 4.

According to a non-shown embodiment, the thermoelectric coolers 74 may be provided within the cavities 70, so that the refrigerant already contained in the cavities 70 may be cooled down.

The number of lubrication refrigerant cavities 70 communicating with the compression chamber 47 and the bearing chambers 51 and 55 may be different, and the number of thermoelectric coolers 74 associated with each of these cavities 70 may be different.

According to an embodiment, the refrigeration apparatus 1 may comprise a refrigerant drain line 80 that recovers refrigerant in the bearing chambers, for example in the discharge bearing chamber 55, and directs the recovered refrigerant towards the evaporator 10, or towards the line 15 connecting the expansion valve 8 to the evaporator 10, or any low pressure section of the refrigerant main circuit 2.

Figure 3:
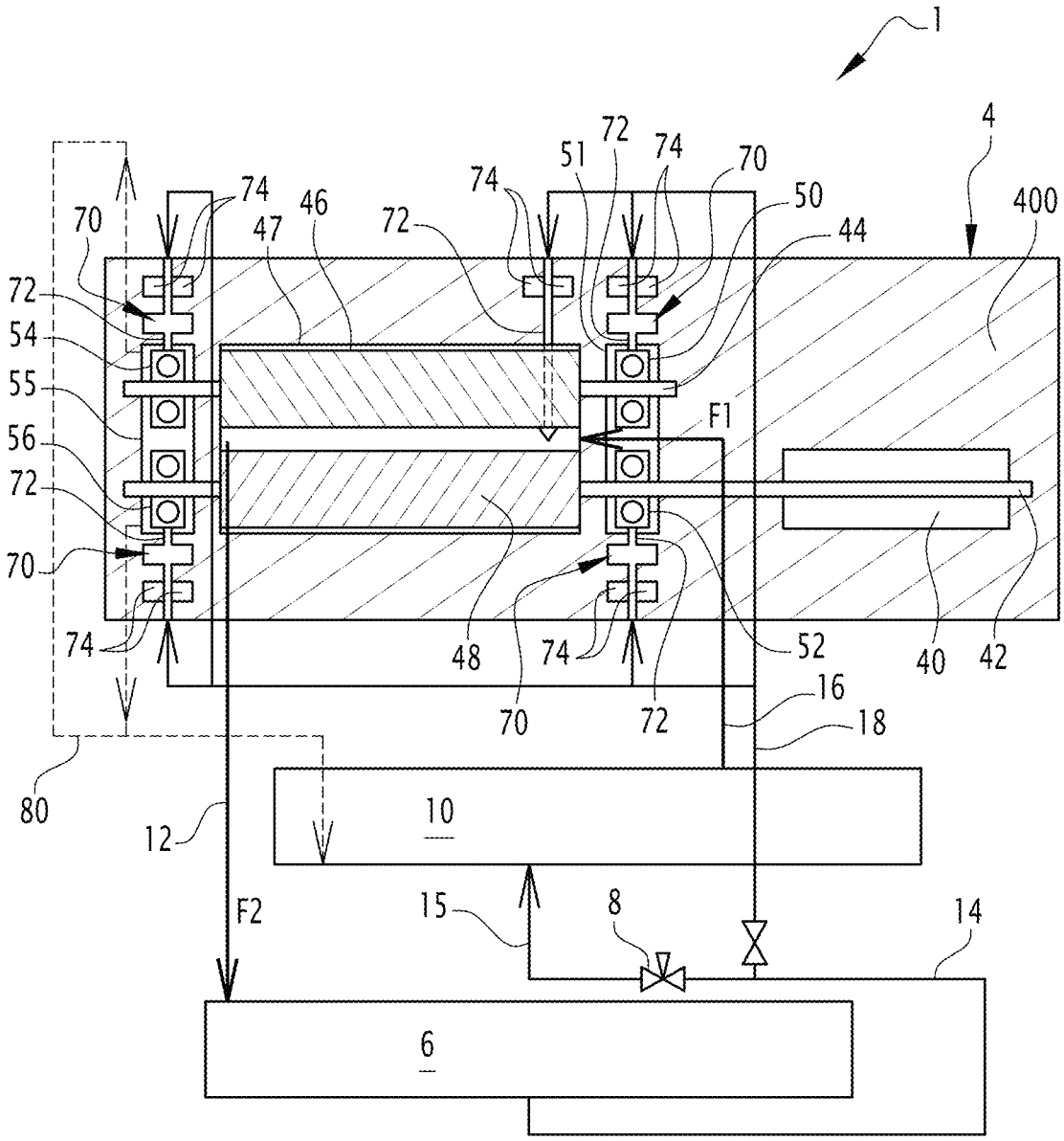
FIG. 3 is a synoptic drawing showing a refrigeration apparatus according to a second embodiment of the invention.
Figure 4:
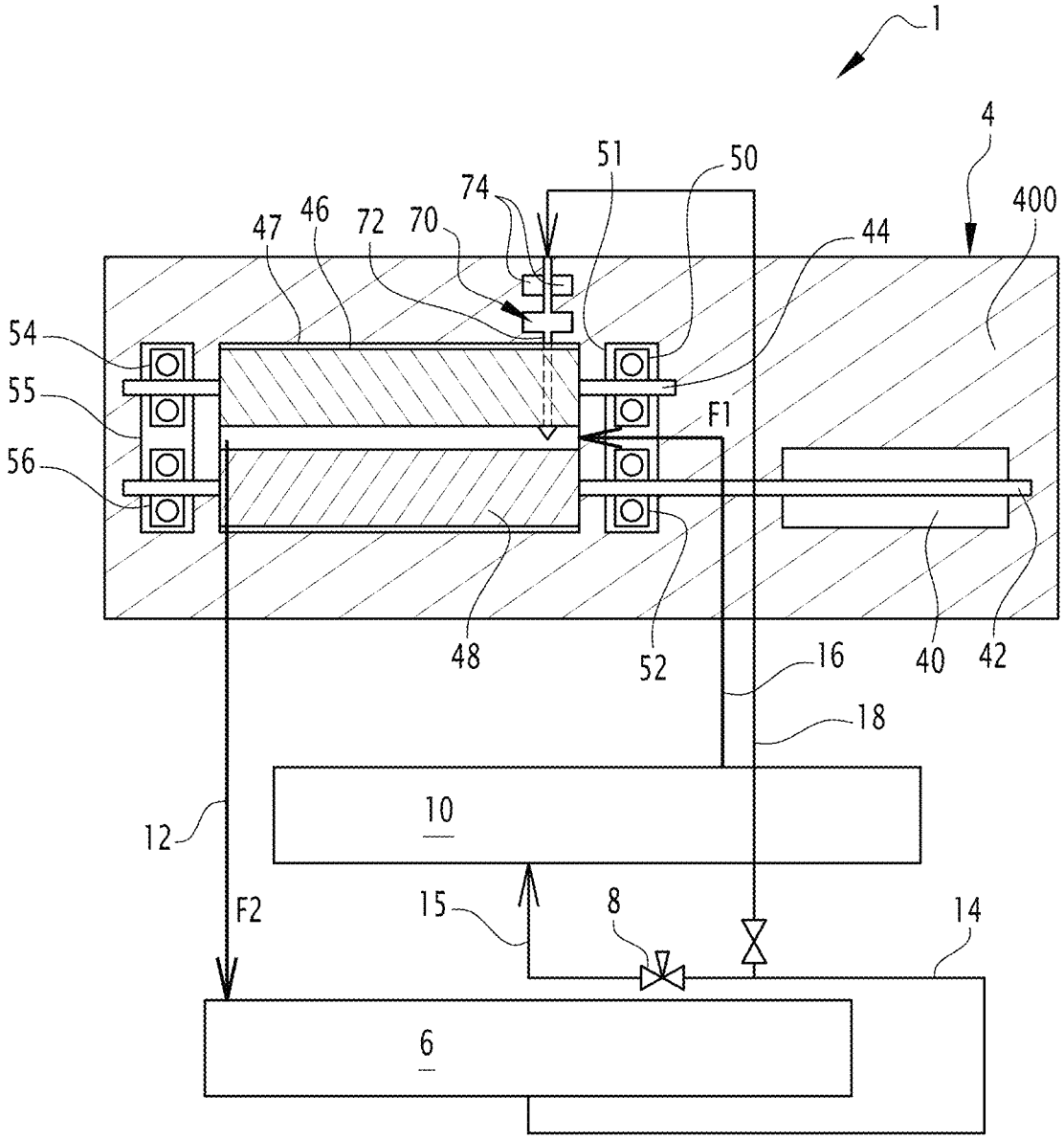
FIG. 4 is a synoptic drawing showing a refrigeration apparatus according to a third embodiment of the invention.

A second and a third embodiments of the invention are shown in FIGS. 3 and 4. In these embodiments, elements common to the embodiment of FIGS. 1 and 2 have the same references and work in the same way.

On FIG. 3, at least one lubrication refrigerant cavity is formed by the compression chamber 47. The compression chamber 47 forms a cavity that is already present within the compressor 4, and which is able to store a certain quantity of refrigerant during a standby period. The refrigerant that enters the compression chamber 47 via the ducts 72 is therefore cooled down by the thermoelectric coolers 74, thereby providing storage of liquid lubricant in the compression chamber 47 for an upcoming start.

On FIG. 4, the bearing chambers 51 and 55 are not provided with refrigerant cavities 70. Only the compression chamber 47 is lubricated using lubrication refrigerant cavities and cooling devices. The bearings 50, 52, 54, 56 may be lubricated by non-shown means involving refrigerant, oil (in such a case with the bearing cavities 51 and 55 fluidly isolated from the compression chamber 47 and the main circuit 2), or any convenient mean.

In a non-shown embodiment, the refrigeration apparatus may comprise only one lubrication refrigerant cavity formed by the compression chamber 47 as shown on FIG. 3, and no cavities dedicated to the bearings, as shown of FIG. 4.

According to a non-shown embodiment, at least one of the lubrication refrigerant storing cavities 70 may be connected to both the compression chamber 47 and to one of the bearing chambers 51 and 55.

According to a non-shown embodiment of the invention, the cooling device for cooling down the refrigerant stored in the lubrication refrigerant cavities 70 or in the compression chamber 47 may comprise a magnetic cooling device or any other suitable device.

According to an optional embodiment, the refrigeration apparatus 1 may comprise a at least one heating device mounted on the condenser 6, or on a shell of the evaporator 10, or both, and configured to heat up the refrigerant contained in the condenser 6 and/or the evaporator 10 to induce migration of liquid refrigerant towards the lubrication refrigerant cavities. For example, the refrigeration apparatus 1 may comprise a heating device formed by a heating belt 28 mounted on a non-shown shell of the evaporator 10, and a heating device formed by a heating belt 30 mounted on a non-shown shell of the condenser 6. The heating belts 28 and 30 may be electrical devices configured to be fed with electrical current before or during a start of the refrigeration device 1. The heating belts 28 and 30 generate heat so that the refrigerant in the shells of the evaporator 10 and the condenser 6 becomes hotter than the refrigerant present in the other places of the main circuit 2 and the lubrication refrigerant line 18, and migrates spontaneously towards the lubrication refrigerant cavities 70.

The technical features of the embodiments and variants described hereabove may be combined to form new embodiments within the scope of the claims.

What is claimed is:

1. A refrigeration apparatus comprising:

a main refrigerant circuit including a positive displacement compressor, a condenser, an expansion valve, and an evaporator, wherein a refrigerant circulates through the main refrigerant circuit successively in a closed loop circulation;

a lubrication refrigerant line connected to the main refrigerant circuit between the condenser and the expansion valve, or to the condenser, the lubrication refrigerant line circulating a portion of the refrigerant of the main refrigerant circuit and connected to the compressor for lubrication of said compressor with the refrigerant;

wherein the refrigeration apparatus comprises:

at least one lubrication refrigerant storing cavity connected to the lubrication refrigerant line, the lubrication refrigerant storing cavity being configured to store liquid refrigerant for lubrication of the compressor, said at least one lubrication refrigerant storing cavity being provided within the compressor, and being in fluid connection with at least a compression chamber of the compressor;

at least one electrically powered cooling device provided within the compressor and configured to cool down the refrigerant stored in said at least one lubrication refrigerant storing cavity prior to a starting operation of the refrigeration apparatus.

2. A refrigeration apparatus according to claim 1, wherein the refrigeration apparatus comprises several lubrication refrigerant storing cavities distributed within the compressor, at least one of said lubrication refrigerant storing cavities being in connection with the compression chamber and with at least one bearing chamber within the compressor.

3. A refrigeration apparatus according to claim 1, wherein said at least one lubrication refrigerant cavity is formed by the compression chamber itself.

4. A refrigeration apparatus according to claim 1, wherein said at least one electrically powered cooling device is formed by a magnetic cooler.

5. A refrigeration apparatus according to claim 1, further comprising at least one heating device mounted on the condenser, or on the evaporator, or both, and configured to heat up the refrigerant contained in the condenser and/or the evaporator to induce migration of liquid refrigerant towards said at least one lubrication refrigerant cavity.

6. A refrigeration apparatus according to claim 1, wherein the refrigeration apparatus operates an oil free refrigerant cycle.

7. A refrigeration apparatus according to claim 1, wherein the refrigeration apparatus comprises several lubrication refrigerant storing cavities distributed within the compressor, at least one of said lubrication refrigerant storing cavities being in connection with the compression chamber, and at least one of said lubrication refrigerant storing cavities being in connection with bearing chambers within the compressor.

8. A refrigeration apparatus according to claim 7, wherein the bearing chambers comprises a suction side bearing chamber and a discharge side bearing chamber, wherein the refrigeration apparatus comprises two lubrication refrigerant storing cavities connected with the suction side bearing chamber, two lubrication refrigerant storing cavities connected with the discharge side bearing chamber and one lubrication refrigerant storing cavity connected with the compression chamber.

9. A refrigeration apparatus according to claim 7, further comprising, for each of said lubrication refrigerant storing cavities, at least one electrically powered cooling device is configured to cool down the refrigerant stored in said lubrication refrigerant storing cavity.

10. A refrigeration apparatus according to claim 1, wherein said at least one electrically powered cooling device comprises at least one thermoelectric cooler.

11. A refrigeration apparatus according to claim 10, wherein the refrigeration apparatus comprises heat dissipation means configured to dissipate a heat generated by said at least one thermoelectric cooler, and wherein the heat dissipation means are formed by a housing of the compressor.

12. A refrigeration apparatus according to claim 10, wherein the refrigeration apparatus comprises an electrical power supply unit configured to feed said at least one thermoelectric cooler with electrical current on the starting operation of the refrigeration apparatus.

13. A refrigeration apparatus according to claim 12, wherein said electrical power supply unit is configured to feed said at least one thermoelectric cooler with electrical current during a limited duration ranging between several seconds and several minutes.

* * * * *